US006042984A

United States Patent [19]

Taniguchi

[11] Patent Number: 6,042,984

[45] Date of Patent: Mar. 28, 2000

[54] IMAGE FORMING METHOD AND IMAGE SUPPORTING MATERIAL

[75] Inventor: Keishi Taniguchi, Shizuoka-ken, Japan

[73] Assignee: Ricoh Company, Ltd., Tokyo, Japan

[21] Appl. No.: 09/094,499

[22] Filed: Jun. 10, 1998

[30] Foreign Application Priority Data

Jun. 10, 1997 [JP] Japan ..... 9-166691

[51] Int. Cl.[7] ..... G03G 13/22

[52] U.S. Cl. ..... 430/126; 430/124

[58] Field of Search ..... 430/124, 126

[56] References Cited

U.S. PATENT DOCUMENTS 3,847,642 11/1974 Rhodes ..... 430/126
5,601,959 2/1997 Brault et al. ..... 430/126
5,658,701 8/1997 Kato ..... 430/49
5,700,612 12/1997 Kato et al. ..... 430/126
5,928,823 7/1999 Kato ..... 430/126

FOREIGN PATENT DOCUMENTS 46-8039 1/1971 Japan ..... 430/124

*Primary Examiner*—Roland Martin
*Attorney, Agent, or Firm*—Oblon, Spivak, McClelland, Maier & Neustadt, P.C.

[57] ABSTRACT

An image forming method and an image supporting material are provided. An image is formed on a transfer layer of an image transfer material and transferred onto an image receiving material together with at least one part of the transfer layer, and then a transparent resin layer is formed on at least one part of the image transferred on the image receiving material to prepare the image supporting material.

8 Claims, No Drawings

IMAGE FORMING METHOD AND IMAGE SUPPORTING MATERIAL

BACKGROUND OF THE INVENTION

1. Field of the Invention

The present invention relates to an image forming method and an image supporting material therefor in which an image is formed on an image transfer material by an image recording method such as electrophotography, thermal transfer recording, ink jet recording or the like and the image formed on the image transfer material is transferred onto an image receiving material, such as cloth, canvas, plastics, paper, wood, leather, glass, china, metals or the like, to obtain an image supporting material. Particularly, the invention relates to an image forming method and an image receiving material therefor in which an oil-painting like image having a good durability can be formed on a canvas.

2. Discussion of the Background

Recently, a variety of image forming apparatus have been developed and utilized for copiers and printers for computers or the like. The images formed with these image forming apparatus are used not only for reading or viewing, but also for various new applications.

As one of these new applications of the images, a method is proposed in which the images are transferred onto an image receiving material, such as cloth, canvas, plastics, paper, wood, leather, glass, china, metals or the like. This method is useful for manufacturing a small lot of made-to-order goods having original pictures thereon, such as T-shirts, sweat shirts, aprons, jackets, cups, plates or stained glass, and for manufacturing small lots of pictures duplicated on canvases, which are mainly manufactured for individuals. Currently, since full color copiers are developed and high quality full color images can easily be obtained, the demand for this method is increasing more and more.

An image transfer sheet used in an image forming method in which toner images on the image transfer sheet are transferred onto an above-mentioned image receiving material is discussed in Japanese Laid-Open Patent Publication No. 52-82509, incorporated herein by this reference. In addition, it is well known that colored images are formed on canvases by methods such as screen printing, offset printing, gravure printing or the like.

The thus formed images have poor durability by themselves, and therefore the images have drawbacks in that the images easily deteriorate when scratched or discolor when irradiated with light. In addition, the images formed by the method mentioned above have the following drawbacks: (1) the gloss of the images is relatively low; and (2) the images do not look like oil-painting images or do not have an oil-painting like feeling because the surface of the images is too smooth and homogeneous.

Because of these reasons, a need exists for an image forming method and an image supporting material therefor in which an image having good durability and light resistance can be easily obtained.

SUMMARY OF THE INVENTION

Accordingly, an object of the present invention is to provide an image forming method and an image supporting material therefor in which an image having good durability and light resistance can be easily obtained.

Another object of the present invention is to provide an image forming method and an image supporting material therefor in which an oil-painting like image which has good durability and light resistance and which resists becomes dusty when the image is exhibited on a wall.

Yet another object of the present invention is to provide an image forming method and an image supporting material therefor in which the surface a formed oil-painting-like image has good releasability without adhering to other materials such as paper or films.

Briefly these objects and other objects of the present invention have been attained by an image forming method including the following steps:

(1) forming an image on a transfer layer of an image transfer material, for example, by electrophotography;

(2) transferring the image onto an image receiving material together with at least one part of the transfer layer; and (3) coating at least one part of the transferred image with a transparent resin to form a transparent resin layer thereon.

Accordingly, the first embodiment of the present invention relates to an image forming method that includes:

forming an image on a transfer layer of an image transfer material;

transferring the image onto an image receiving material together with at least one part of the transfer layer; and then forming a transparent resin layer on at least one part of the image transferred on the image receiving material to prepare an image supporting material.

The second embodiment of the present invention relates to an image supporting material that includes:

an image receiving material, an image and a transparent resin layer formed on at least one part of the image, wherein the image is formed on the image supporting material by:

forming a first image on a transfer layer of an image transfer material;

transferring the first image with at least one part of the transfer layer onto an image receiving material to form a second image on the image receiving material; and then forming the transparent resin layer on at least one part of second image on the image receiving material to form the image supporting material.

The third embodiment of the present invention relates to an image forming method that includes:

providing an image transfer material which includes a transfer layer and an image formed on the transfer layer;

transferring the image onto an image receiving material together with at least one part of the transfer layer; and then forming a transparent resin layer on at least one part of the image transferred on the image receiving material to prepare an image supporting material.

The fourth embodiment of the present invention relates to an image supporting material that includes:

an image receiving material, a first image, and a transparent resin layer formed on at least one part of the first image, wherein the first image is formed on the image supporting material by:

providing an image transfer material that includes a transfer layer and a second image formed on the transfer layer;

transferring the second image with at least one part of the transfer layer onto an image receiving material to form the first image on the image receiving material; and then forming the transparent resin layer on at least one part of the first image on the image receiving material to form the image supporting material.

DESCRIPTION OF THE PREFERRED EMBODIMENTS

Other features of the invention will become apparent in the course of the following descriptions of preferred embodiments, which are given for the purpose of illustration only and are not intended to be limiting.

The transparent resin preferably includes at least one of an ultraviolet light absorbing agent, a photostabilizer, an antioxidant and a quencher.

The transparent resin preferably includes a self-crosslinking polymer.

The image forming method of the present invention preferably includes, for example, as follows:

(1) forming an image on a transfer layer formed on an image transfer material with toner, ink, a dye or the like by electrophotography, thermal transfer recording, ink jet printing, hand writing or the like;

(2) applying heat and pressure to the image transfer material to transfer the image on an image receiving material such as a canvas together with at least one part of the transfer layer; and (3) coating a transparent resin on at least one part of the transferred image to form a resin layer on the image, i.e., to obtain an image supporting material which has a resin coated images thereon.

Preferably, in the forming of the first and second images, the first and second images may be reversed with respect to each other or not reversed with respect to each other. By reversed, it is meant that the first and second images are mirror images. More preferably, the images are reversed with respect to each other.

A suitable image transfer material for use in the present invention includes transfer sheets useful for image forming methods that include an image transfer step. For example, transfer sheets disclosed in Japanese Laid-Open Patent Publication No. 52-82509. The entire contents of which are hereby incorporated by reference. The image transfer material preferably includes a release layer between the transfer layer and a substrate of the image transfer material.

Transparent resins useful for coating the surface of the image receiving material of the present invention are not limited to colorless and substantially transparent resins, and include resins which have a transparency such that an image can be easily recognized when the image is covered with the resin. Therefore, transparent resins which are slightly colored can also be used. From a standpoint of visibility, resins which can form a layer having a transparency of from about 30 to about 100%, in a visible light region are preferable as the transparent resin, more preferably from about 40 to about 100%, and most preferably from about 50 to about 100%. These ranges include all values and subranges therebetween. In addition, a resin having a glass transition temperature (Tg) not lower than 0° C. is preferably included in the transparent resin layer to prepare an image supporting material having good releasability from paper, films, or other materials. More preferably the Tg is not lower than 10° C., and most preferably not lower than 20° C. Each of the above ranges include all values and subranges therebetween.

The transparent resins for use in the present invention are preferably resins which can strongly adhere to materials used for the transfer layer of the image transfer material of the present invention. In addition, the transparent resins are preferably resins which hardly penetrate into the transfer layer. The terms "the transparent resins hardly penetrate into the transfer layer" mean that the transparent resin can form a resin layer at least on one part of the surface of the image to be coated even after drying and/or crosslinking the coated transparent resin.

Suitable materials for use in the transfer layer of the image transfer material of the present invention are not particularly limiting and may be selected from those typically known in the art. Specific examples of such resins include polystyrene resins, polyester resins, polyamide resins, polyethylene resins, polypropylene resins, polybutadiene resins (including isoprene resins and chloroprene resins), fluorine-contained resins, polyurethane resins, cellulose resins, ethylene-vinyl chloride copolymers, maleic acid copolymers, vinyl acetate resins and saponified resins thereof, acrylic resins, epoxy resins, xylene resins, cumarone resins, ketone resins, petroleum resins, phenolic resins, rosins, terpene resins, fatty acid amides, and copolymers thereof.

When an ink image is formed on the transfer layer by thermal transfer recording, suitable resins for use in the transfer layer are not particularly limiting and may be selected from those typically know in the art and include waxes and resins such as styrene-acryl copolymers, ethylene-vinyl acetate copolymers, ethylene-vinyl acetate-vinyl alcohol copolymers, vinylchloride-vinylacetate copolymers, polybutadiene resins, polyisoprene resins, polyisobutylene resins, polychloroprene resins, polystyrene resins, polyester resins, petroleum resins, polyvinyl alcohol resins, methyl cellulose resins, gelatin, carboxymethyl cellulose, gum arable, starch and derivatives thereof, casein, polyvinyl pyrrolidone resins.

These resins can be formed on the image transfer material by coating, for example, an aqueous solution or dispersion, an organic solvent solution or dispersion, or a hot-melted liquid of these resins.

Suitable transparent resins for use in the transparent resin layer of the image supporting material include thermoplastic resins, room-temperature-crosslinking resins, heat-crosslinking resins, ultraviolet-light-crosslinking resins, electron-beam-crosslinking resins. These resins are dissolved or dispersed in a solvent so that the resultant coating liquid hardly deteriorates the image to be coated. In addition, the coating liquid preferably has a proper viscosity and/or a thixotropic property to form a transparent resin layer on the image to be coated. The viscosity and thixotropic properties can be easily determined according to know methods.

Specific examples of such resins include polyurethane resins; polyamide resins; polyester resins; polyolefin resins; cellulose derivatives such as nitrocellulose resins and acetylcellulose resins; styrene resins or styrene copolymers such as polystyrene and poly-α-methylstyrene; (meth) acrylic resins such as polymethyl (meth)acrylate, polyethyl (meth)acrylate; vinyl copolymers such as vinyl chloride-vinyl acetate copolymers and ethylene-vinyl acetate copolymers; rosin ester resins such as rosin and rosin modified maleic acid resins; natural or synthetic rubbers such as polyisoprene rubbers end styrene-butadiene rubbers; ionomers; epoxy resins; phenolic resins; glue; linseed oil; gelatin; casein; and the like.

Polyurethane resins include a thermoplastic polyurethane resins obtained by the reaction of an isocyanate compound and a polyol compound having hydroxy groups at the end of the molecule. Specific examples of the isocyanate compounds include aromatic diisocyanate compounds, such as tolylene diisocyanate, diphenylmethane-4,4'-diisocyanate;

alicyclic diisocyanate compounds such as isophorone diisocyanate; and aliphatic diisocyanate compounds, such as trimethylene diisocyanate, tetramethylene diisocyanate, hexamethylene diisocyanate and dodecamethylene diisocyanate. The polyol compounds include polyhydroxy compounds, such as alkanepolyol, polyesterpolyol and polyetherpolyol. Specific examples of alkanepolyol include 1,5-pentanediol, 1,8-octanediol, 1,10-decanediol and 1,12-dodecanediol. Specific examples of polyesterpolyol include, for example, aliphatic polyesterdiol compounds including at least one of aliphatic dial compounds and aliphatic dicarboxylic acid compounds, which are mentioned later, as a constitutional unit. Specific examples of the polyetherpolyol include diethyleneglycol, triethyleneglycol, polyethylene glycol, tripropylene glycol, polypropylene glycol and adducts of bisphenol A and an alkylene oxide such as ethylene oxide.

Specific examples of the polyamide resins include nylon 6, nylon 11, nylon 12, nylon 13, nylon 610, nylon 612 and nylon 616.

Specific examples of polyester resins include polyester resins having at least one of aliphatic diol compounds and aliphatic dicarboxylic acid compounds as a constitutional unit, and polyester resins having both of an aliphatic dial compound end an aliphatic dicarboxylic acid compound are more preferable. Preferably, the aliphatic dicarboxylic acid compounds are saturated aliphatic carboxylic acid compounds. Specific examples of the aliphatic diol compounds include ethylene glycol, diethylene glycol, triethylene glycol, polyethylene glycol, propylene glycol, dipropylene glycol, tripropylene glycol, polypropylene glycol, 1,3-butanediol, 1,4-butanediol, neopentyl glycol, 1,6-hexanediol and polymethylene glycol. Specific examples of the aliphatic carboxylic acid compounds include saturated aliphatic dicarboxylic acid compounds, such as succinic acid anhydride, adipic acid, azelaic acid, sebacic acid, suberic acid and dodecanedioic acid, and unsaturated aliphatic carboxylic acid compounds such as maleic acid and fumaric acid.

Specific examples of the polyolefin include polyethylene such as low density polyethylene and linear low density polyethylene; and modified polyolefins, such as ethylene-1-butene copolymers, ethylene-(4-methyl-1-pentene) copolymers, ethylene-vinyl acetate copolymers, ethylene-(meth)acrylic acid copolymers, ethylene-(meth)acrylate copolymers, propylene-1-butene copolymers, ethylene-propylene copolymers, ethylene-propylene-1-butane copolymers and maleic anhydride modified polyethylene and maleic anhydride modified polypropylene. Preferred polyolefin compounds are the modified polyolefins mentioned above.

In addition, suitable materials for use in the transparent resin layer include polymer compounds such as ethylene-vinyl acrylate copolymers, ethylene-ethyl acrylate copolymers, polyvinyl butyral, polyvinyl acetal, ethylene vinyl acetate-acryl copolymers including a self-crosslinking component such as methylol group and/or an alkoxymethyl group, polyvinyl alcohol, methyl cellulose, carboxymethyl cellulose, polyethylene oxide, polyvinyl pyrrolidone, starch, modified starch, gelatin, silicone resins, and modified resins thereof; and wax compounds such as polyethylene wax, paraffin wax, carnauba wax, candelilla wax, rice wax, lanolin wax, ester wax, oxidized wax, and petroleum resinous wax. These compounds can be included in the transparent resin layer alone or in combination.

Among these resin materials, self-crosslinking polymers are preferable, and self-crosslinking polymers having a methylol group and/or an alkoxymethyl group are more preferable, and ethylene-vinyl acetate-acrylate copolymers having a methylol group and/or an alkoxymethyl group are even more preferable, to obtain an image having good preservability and heat resistance. In addition, these resins have good coating properties because the resin solutions or dispersions have relatively low viscosity when they are coated. In drying and optional heating operations performed after the coating operation, the resins may crosslink and thereby the resultant resin layer has good heat resistance. Further, these resins have advantages in that a coating liquid including one or more of these resins has good preservability, and the resultant resin layer can be easily crosslinked by heating. Furthermore, ethylene-vinyl acetate-acrylate copolymers having a methylol group and/or an alkoxymethyl group have an advantage in that they have good adhesion to various image receiving materials as well as the advantages already mentioned above.

In addition, the transparent resin layer preferably includes a resin having a glass transition temperature, Tg, not lower than 0° C., to prevent the surface of the image supporting material from adhering to paper, films or other materials. More preferably the Tg is not lower than 10° C., and most preferably not lower than 20° C. Each of the above ranges include all values and subranges therebetween.

The transparent resin layer preferably includes a resin similar to the resin used in the transfer layer of the image transfer material to obtain good adhesion of the resin layer and the transferred image, and thereby the durability of the image can be improved. In other words, the transparent resin layer and the transfer layer preferably include resins which belong to the same resin group when the resins are classified, for example, polyester resins, polyurethane resins, ethylene-vinyl acetate resins and the like.

The transparent resin layer may also include additives such as tackifiers, antioxidants, ultraviolet light absorbing agents, photostabilizers, quenchers, lubricants, colorants, antistatic agents, plasticizers and fillers, if desired.

In particular, when the transparent resin layer preferably includes at least one of ultraviolet light absorbing agents, photostabilizers, antioxidants and quenchers, the light resistance of transferred images can be improved.

The transparency of the transparent resin layer is preferably in the range of from about 100 to about 30% even when the layer includes these additives. The transparency is more preferably from about 40 to about 100%, and most preferably from about 50 to about 100%. These ranges include all values and subranges therebetween.

Suitable ultraviolet light absorbing agents for use in the transparent resin layer of the image supporting material of the present invention include salicylic acid compounds such as phenyl salicylate, p-di-tert-butylphenyl salicylate, p-octylphenyl salicylate; benzophenone compounds such as 2,4-dihydroxybenzophenone, 2-hydroxybenzophenone, 2-hydroxy-4-octoxybenzophenone, 2-hydroxy-4-dodecyloxybenzophenone, 2,2'-dihydroxy-4-methoxybenzophenone, 2,2'-dihydroxy-4,4'-dimethoxybenzophenone, and 2-hydroxy-4-methoxy-5-sulfobenzophenone: benzotriazole compounds such as 2-(2'-dihydroxy-5'-methylphenyl)benzotriazole, 2-(2'-hydroxy-5'-tert-butylphenyl)benzotriazole, 2-(2'-hydroxy-3'-tert-butyl-5'-methylphenyl)benzotriazole, 2-(2'-hydroxy-3',5'-chlorobenzotriazole, and 2-(2'-hydroxy-3',5'-di-tert-amylphenyl)benzotriazole; cyano acrylate compounds such as 2-ethylhexyl-2-cyano-3,3'-diphenylacrylate, and ethyl-2-cyano-3,3'-diphenylacrylate; metal oxides such as titanium oxide, zinc oxide, and cerium oxide; oxalic acid anilide compounds) triazine compounds; dibenzoylmethane compounds; and benzylidene compounds.

Polymeric ultraviolet light absorbing agents in which one or more of the ultraviolet light absorbing agents mentioned above is incorporated in a polymer are preferably used in the transparent resin layer. The transparent resin layer including such a polymeric ultraviolet light absorbing agent has good preservability without the occurrence of unwanted phase separation between the transparent resin and the ultraviolet light absorbing agent, resulting in bleeding of the ultraviolet light absorbing agent or blushing of the transparent resin layer.

Photostabilizers can effectively scavenge radicals which are generated from the transferred color dye images when ultraviolet light is irradiated to the images, and therefore a chain reaction is avoided by making the radicals inactive, resulting in prevention of the dye images from deteriorating. Specific examples of such photostabilizers include hindered amines such as 4-benzoyloxy-2,2,6,6-tetramethylpiperidine, bis(2,2,6,6-tetramethyl-4-piperidyl)sebacate, bis(1,2,2,6,6-pentamethyl-4-piperidyl)sebacate, bis(1,2,2,6,6-pentamethyl-4-piperidyl)-2-(3,5-di-tert-butyl-4-hydroxybenzyl)-2-n-butyl malonate, and tetrakis(2,2,6,6-tetramethyl-4-piperidyl)-1,2,3,4-butanetetracarboxylate; hindered phenols such as 2,4-di-tert-butylphenyl-3,5-di-tert-butyl-hydroxybenzoate; nickel complexes such as [2,2'-thiobis-(4-tert-butylphenolate)]-tert-butylaminenickel (II), and [2,2'-thiobis-(4-tert-butylphenolate)]-2-ethylhexylamine nickel (II); and nickel salts of phosphoric esters such as nickel salts of 3,5-di-tert-butyl-4-hydroxybenzyl monoethyl phosphate.

The antioxidants are classified into two types. One type of antioxidant is a radical acceptor type which can stabilize radical peroxides by donating protons. The other is a peroxide separating type which can change hydroperoxides into stable alcohols.

Specific examples of such radical acceptor type antioxidants include phenol compounds such as hydroquinone; gallate; and hindered phenol compounds such as 2,6-di-tert-butyl-p-cresol, stearyl-β-(3,5-di-tert-butyl-4-hydroxyphenyl)propionate, 2,2'-methylenebis(4-methyl-6-tert-butylphenol), 2,2'-methylenebis(4-ethyl-6-tertbutylphenol), 4,4'-thiobis(3-methyl-6-tert-butylphenol), 1,1,3-tris(2-methyl-4-hydroxy-5-tert-butylphenyl)butane, 1,3,5-trimethyl-2,4,6-tris(3,5-di-tert-butyl-4-hydroxybenzyl)benzene, tris(3,5-di-tert-butyl-4-hydroxybenzyl)isocyanurate, and tetrakis[methylene-3-(3',5'-di-tert-butyl-4-hydroxyphenyl)propionate]methane. Amine compounds can be used as the radical acceptor type antioxidants. Specific examples of such amine compounds include N.N'-diphenyl-p-phenylenediamine, phenyl-β-naphthylamine, phenyl-α-naphthylamine, N,N'-β-naphthyl-p-phenylenediamine, N.N'-diphenylethylenediamine, phenothiazine, N,N'-di-sec-butyl-p-phenylenediamine, and 4,4'-tetramethyl-diaminodiphenylmethane.

Suitable peroxide separating type antioxidants include sulfur containing compounds and phosphorus containing compounds. Specific examples of such sulfur containing compounds include dilaurylthiodipropionate, distearylthiodipropionate, laurylstearylthiodipropionate, dimyristylthiodipropionate, distearyl-β,β-thiodibutyrate, 2-mercaptobenzimidazole, and dilaurylsulfide. Specific examples of such phosphorus containing compounds include triphenyl phosphite, trioctadecyl phosphite, tridecyl phosphite, trilauryl trithiophosphite, diphenylisodecyl phosphite, trinonylphenyl phosphite, and distearylpentaerythritol phosphite.

The quenchers can take energy from exited molecules and thereby the reaction of the molecules can be avoided. Suitable quenchers for use in the present invention include known metal complexes.

By adding at least one of these ultraviolet light absorbing agents, photostabilizers, antioxidants and quenchers in the transparent resin layer of the image supporting material of the present invention, discoloring of the transferred images which is caused by irradiation of light or deterioration with time can be decreased.

As for coating methods of the transparent resin layer, known coating and printing methods can be employed. For example, brush coating, flow coating, spray coating, screen printing, gravure printing, and offset printing can be used. A transparent resin layer coating liquid, such as a solution, an emulsion or a dispersion type liquid, is coated on at least one part of the surface of a transferred image by one of these coating method and then dried to form a transparent resin layer on the image. To obtain an oil-painting like image, the transparent resin layer preferably has an uneven thickness depending on each image of the picture image, and therefore a brush coating is preferably used for this case. This is because when the transparent resin layer is coated with a brush, the resin layer tends to have streaks which is caused by the brush, which allows the image to appear more real.

Suitable lubricants for use in the transparent resin layer include waxes such as polyethylene wax, paraffin wax, carnauba wax, candelilla wax, rice wax, lanolin wax, ester wax, oxidized wax, petroleum resinous wax, stearic acid amide, and zinc stearate; polymeric plasticizers such as polyethylene glycol esters, and polyesters; higher fatty acids such as stearic acid, and palmitic acid; higher alcohols and esters thereof such as octadecanol, and hexadecanoyl palmitate: aliphatic acid diesters such as di-2-ethylhexyl adipate; silicone compounds; phosphoric acid esters such as tricresyl phosphite. By including one or more of these lubricants in the transparent resin layer, dust hardly adheres to the resultant resin layer, resulting in prevention of the image from becoming dirty, and in addition the resultant image supporting material has good releasability from paper, film or other materials.

Suitable fillers for use in the transparent resin layer include known fillers which are conventionally used as additives of plastics. Specific examples of such fillers include calcium carbonate, magnesium carbonate, barium sulfate, gypsum, clay, kaolin, alumina, talc, diatom earth, silica, magnesium silicate, mica powder, glass powder, asbestos, rock wool, montmorillonite, antimony trioxide, calcium sulfate, zinc stearate, aluminum stearate, titanium oxide, zinc hydroxide, and calcium silicate. By including one or more of these fillers in the transparent resin layer, the resultant image supporting material comes to have good releasability from paper, films or other materials.

Suitable colorants for use in the transparent resin layer include known dyes or pigments which are conventionally used for plastics. For example, the dyes include direct dyes, acid dyes, basic dyes, mordant dyes, sulfur dyes, sulfur vat dyes, vat dyes, azoic dyes, disperse dyes, reactive dyes, oxidation dyes, and fluorescent brightening agents. Specific examples of such dyes include azo ayes such as monoazo ayes, polyazo dyes, metal complex azo dyes, pyrazolone azo dyes, stilbene azo dyes, and thiazole azo dyes; anthraquinone dyes such as anthraquinone derivatives, and enthrone derivatives; indigoid dyes such as indigo derivatives, and thioindigo derivatives; carbonium dyes such as diphenylmethane dyes, triphenylmethane dyes, xanthene dyes, and acridine dyes; quinoneimine dyes such as azine dyes, oxazine dyes, and thiazine dyes; methine dyes such as polymethine (or cyanine) dyes, and azomethine dyes; phthalocyanine dyes; quinoline dyes; nitro dyes; nitroso dyes; benzoquinone dyes; naphthoquinone dyes; naphthalimide dyes; and perynone dyes.

The pigments for use as colorants in the transparent resin layer include inorganic and organic pigments. Specific examples of such inorganic pigments include natural inorganic pigments such as clay, baryta, mica, and loess; oxides such as titanium white, zinc white, red iron oxide, chromium oxide, iron black, alumina white, and yellow iron oxide; sulfides such as cadmium yellow, cadmium red, zinc sulfide, antimony sulfide, and silver orange; carbonates such as calcium carbonate, and magnesium carbonate; silicates such as calcium silicate, ultramarine, and talc; chromates such as chrome yellow, zinc yellow, barium yellow, and molybdenum red; ferrocyanides such as Prussian blue; hydroxides such as aluminum hydroxide, and viridian; carbon such as carbon black, vegetable black, bone black, and graphite; metal powders such as aluminum powder, bronze powder, and zinc powder.

Specific examples of the organic pigments include natural dye type pigments such as Madder Lake, Logwood Lake, and cochineal lake; azo lake pigments such as Carmine 6B, Red 2B, and Lake red C; insoluble azo pigments such as disazo yellow, Hansa Yellow, and Naphthol Red; condensed azo pigments such as polyazo yellow, and polyazo red; phthalocyanine pigments such as copper Phthalocyanine Blue, metal-free Phthalocyanine Blue, Sky Blue, chlorinated Phthalocyanine Green, and brominated Phthalocyanine Green; anthraquinone pigments such as Anthraquinone Yellow, and Anthraquinone Red; quinacridone pigments such as quinacridone red, quinacridone pink, and quinacridone violet; isoindolenone pigments such as isoindolenone yellow; dioxazine pigments such as dioxazine violet: perylene pigments such as perylene red; perynone pigments such as perynone red; quinophthalone pigments such as quinophthalone yellow; metal complex pigments; basic dye type pigments such as Rhodamine Lake, Malachite Green, and Methyl Violet; acid dye type pigments such as Peacock Blue Lake, Eosine Lake, and Quinoline Yellow Lake; vat dye type pigments such as Indanthrene Blue, and Thioindigo red; mordant dye type pigments such as Alizarine Lake; and other pigments such as pyranthron, pyrazolone, and organic fluorescent pigments.

By including one or more of these dyes and pigments in the transparent resin layer, an antique image can be obtained. In addition, by emphasizing a part of an image by coating this colored resin layer, a new creative image can be obtained.

The thickness of the transparent resin layer is preferably from about 0.1 $\mu$m to about 30 mm to maintain good durability of the image and oil-painting feeling of the image. In addition, the terms "the transparent resin layer has uneven thickness" mean in the present invention that the difference between a maximum thickness and a minimum thickness of the transparent resin layer is greater than about 3 $\mu$m.

A suitable substrate of the image receiving material include cloth, canvas, plastics, paper, wood, leather, glass, china, metals or the like. In particular, to obtain an image receiving material having an oil-painting-like image, the following canvases are preferable but are not limited to:

Thick type canvases in which a white oil paint including a linseed oil is coated onto linen cloth; standard type canvases in which a white oil paint including linseed oil is coated onto linen cloth in a thin layer; glued canvases in which glue is coated on linen cloth to fill the cloth; canvases for acryl paints which have vinylon cloth or vinylon cloth with cotton blended; AC canvases in which an acrylic paint is coated on a cotton cloth; securies canvases whose surface is coated with a paint including linseed oil serving as a vehicle which is mixed with lead white or calcium carbonate; semi-oil canvases in which a paint including glue, linseed oil, lead white, titan white and calcium carbonate; and tempera canvases in which a paint including glue, yolk, linseed oil, bologna gypsum and titan white. In addition, image receiving materials can be used in which a material such as linseed oil, glue, gelatin, casein or a resin is coated on cloth such as linen, cotton or vinylon and further thereon a paint including a pigment such as lead white, zinc white, titanium white, lithopone, calcite, chalk, marble powder, white clay or kaolin is optionally coated. Further, mere cloth such as linen, cotton or vinylon can be used as an image receiving material.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Example 1

Method for Manufacturing Image Transfer Material

The following components were mixed to prepare a release layer coating liquid (A).

| Formulation of release layer coating liquid (A) | |
|---|---|
| Emulsion of room temperature-crosslinking silicone (SE-1980 clear, manufactured by Dow Corning-Toray Silicone Co., Ltd., solid content of 45%) | 10 |
| Water | 40 |

The release layer coating liquid (A) was coated with a wire bar on one side of a paper sheet having a basis weight of 104.7 g/m$^2$ which served as a substrate, and then dried to form a release layer having a coating weight of 1.7 g/m$^2$ on dry basis.

The following components were mixed to prepare a transfer layer coating liquid (A).

| Formulation of transfer layer coating liquid (A) | |
|---|---|
| Emulsion of self-crosslinking ethylene-vinyl acetate-acryl copolymer having a methylol group (Polysol EF-421, manufactured by Showa Highpolymer Co., Ltd., glass transition temperature of −21° C., solid content of 45%) | 10 |
| Emulsion of self-crosslinking ethylene-vinyl acetate-acryl copolymer having a methylol group (Polysol EF-250N, manufactured by Showa Highpolymer Co., Ltd., glass transition temperature of 20° C., solid content of 50%) | 10 |

The transfer layer coating liquid (A) was coated with a wire bar on the previously prepared release layer, and then dried to form a transfer layer having a coating weight of 30 g/m$^2$ on dry basis. Thus an image transfer material (a) was prepared.

Method for Forming Image on Image Transfer Material

The thus prepared transfer material was cut to obtain a sheet of B4 size. The sheet was installed in a full color copier PRETER 550 manufactured by Ricoh Co., Ltd., and a mirror image of a photograph of a landscape picture was reproduced so that the colored mirror image was formed on the transfer layer of the image transfer material. This reproduction was performed with permission of the painter. The image transfer material with colored image was then cut into a sheet of F4 size (334 mm×243 mm) so that the image was placed in the center of the sheet.

Method for Preparing Image Receiving Material

A sheet of F4 size of the image transfer material (a) without an image thereon was overlaid on a canvas useful for acrylic oil painting (manufactured by Holbein Art Materials Inc., medium cross of vinylon cloth) so that the transfer layer contacted the canvas. The image transfer material and the canvas were pressed at 160° C. for 15 seconds with a thermopressing machine (Rotary Press, manufactured by Mainichi Mark Co., Ltd.) to unify the image transfer material and the canvas. After cooling to room temperature, the image transfer material (a) was released from the canvas. A uniform transparent resin layer of F4 size was formed on the canvas without void.

A transparent resin layer was overlaid on the transparent resin layer previously formed on the canvas in the same way as mentioned above. Thus a canvas on which two transparent resin layers were overlaid, i.e., an image receiving material, was prepared. The thickness of the overlaid transparent resin layers was clearly thicker than that of the single transparent resin layer.

Method for Forming Image on Image Receiving Material

Method for Preparing Image Supporting Material

The mirror image which was previously formed on the image transfer material (a) was transferred onto the overlaid transparent resin layers of the image receiving material in the same way as mentioned above. A clear picture image was reproduced on the image receiving material.

A transparent resin coating liquid (a) which was the same liquid as the image transfer layer coating liquid (A) was coated with a brush on the picture image transferred on the image receiving material, and then dried to form a transparent resin layer on the picture image. In this case, the thickness of the coated transparent resin layer was from 0.5 to 5 mm and was relatively thick on the surface of a tree part of the picture image and relatively thin on a sky part of the picture image. Thus an image supporting material (a) of the present invention was prepared. The image of the image supporting material (a) looked like the original picture and had a good painting-like feeling because the thickness of the image was different in each part of the image, which made the image stereoscopic, and the streaks caused by the brush coating were observed on the transparent resin layer, thereby the image had reality. The adhesion between the image and the transparent resin layer was so strong that the transparent resin layer could not be scraped off when scratched with a nail.

Example 2

The procedure for preparation of the image supporting material (a) in Example 1 was repeated to prepare an image supporting material (b) of the present invention except that the transparent resin layer coating liquid (a) was replaced with the following transparent resin layer coating liquid (b):

| Formulation of transparent resin layer coating liquid (b) | |
|---|---|
| Emulsion of self-crosslinking ethylene-vinyl acetate-acryl copolymer having a methylol group (Polysol EF-250N, manufactured by Showa Highpolymer Co., Ltd., glass transition temperature of 20° C., solid content of 50%) | 10 |
| Emulsion of poly(meth)acrylate having a 2-hydroxy benzophenone skeleton (polymeric ultraviolet light absorbing agent) (UVA-383MA, manufactured by BASF Ltd., glass transition temperature of 27° C., solid content of 30%) | 10 |

The image of the image supporting material (b) looked like the original picture and had a good painting-like feeling. When the image supporting materials (a) and (b) were subjected to a sun light resistant test for 6 months, the image supporting material (b) was hardly discolored, although the image supporting material (a) was slightly discolored.

Example 3

The procedure for preparation of the image supporting material (a) in Example 1 was repeated to prepare an image supporting material (c) of the present invention except that the transparent resin layer coating liquid (a) was replaced with the following transparent resin layer coating liquid (c):

| Formulation of transparent resin layer coating liquid (c) | |
|---|---|
| Emulsion of self-crosslinking ethylene-vinyl acetate-acryl copolymer having a methylol group (Polysol EF-421, manufactured by Showa Highpolymer Co., Ltd., glass transition temperature of −21° C., solid content of 45%) | 10 |
| Emulsion of self-crosslinking ethylene-vinyl acetate-acryl copolymer having a methylol group (Polysol EF-250N, manufactured by Showa Highpolymer Co., Ltd., glass transition temperature of 20° C., solid content of 50%) | 10 |
| Emulsion of stearic acid amide (Himicron G-270, manufactured by Chukyo Yushi Co., Ltd. solid content of 21.5%) | 5 |

The image of the image supporting material (c) looked like the original picture and had a good painting-like feeling. When the image supporting materials (a) and (c) were subjected to a wall test for 6 months, the image supporting material (c) was hardly dirtied with dust, although the image supporting material (a) was slightly dirtied with dust.

Example 4

The procedure for preparation of the image supporting material (a) in Example 1 was repeated to prepare an image supporting material (d) of the present invention except that the transparent resin layer coating liquid (a) was replaced with the following transparent resin layer coating liquid (d):

| Formulation of transparent resin layer coating liquid (d) | |
|---|---|
| Emulsion of self-crosslinking ethylene-vinyl acetate-acryl copolymer having a methylol group (Polysol EF-421, manufactured by Showa Highpolymer Co., Ltd., glass transition temperature of −21° C., solid content of 45%) | 5 |

-continued

| Formulation of transparent resin layer coating liquid (d) | |
|---|---|
| Emulsion of self-crosslinking ethylene-vinyl acetate-acryl copolymer having a methylol group (Polysol EF-250N, manufactured by Showa Highpolymer Co., Ltd., glass transition temperature of 20° C., solid content of 50%) | 10 |
| Ochrous watercolor (manufactured by Guitar Paint Co., Ltd.) | 0.5 |

The image of the image supporting material (d) looked like the original picture and had a good painting-like feeling. In addition, the image supporting material (d) had an antique feeling because the image supporting material (d) yellowed.

Example 5

The procedure for preparation of the image supporting material (a) in Example 1 was repeated to prepare an image supporting material (e) of the present invention except that the transparent resin layer coating liquid (a) was replaced with the following transparent resin layer coating liquid (e):

| Formulation of transparent resin layer coating liquid (e) | |
|---|---|
| Emulsion of self-crosslinking ethylene-vinyl acetate-acryl copolymer having a methylol group (Polysol EF-421, manufactured by Showa Highpolymer Co., Ltd., glass transition temperature of −21° C., solid content of 45%) | 10 |
| Emulsion of self-crosslinking ethylene-vinyl acetate acryl copolymer having a methylol group (Polysol EF-250N, manufactured by Showa Highpolymer Co., Ltd., glass transition temperature of 20° C., solid content of 50%) | 10 |
| Fine particulate titanium dioxide | 1 |

(TTO-55(B), manufactured by Ishihara Sangyo Kaisha Ltd.) The image of the image supporting material (e) looked like the original picture and had a good painting-like feeling. When the image supporting materials (a) and (e) were subjected to a press test for 1 month in which paper was overlaid on each image supporting material while the paper and the image supporting material was pressed with a load of 1 kg. After the test, the paper was peeled from each image supporting material, the paper on the image supporting material (e) could be clearly peeled off and there was no residual paper on the surface of the image supporting material (e), although there was residual paper on the surface of the image supporting material (a) because of slight adhesion therebetween.

Comparative Example 1

The procedure for preparation of the image supporting material (a) in Example 1 was repeated to prepare a comparative image supporting material (f) except that the transparent resin layer was not formed. The image supporting material (f) had less reality than the image supporting materials (a)–(e) of the present invention because the image supporting material (f) was not stereoscopic and did not have streaks on the surface thereof.

This application is based on Japanese Patent Application No. 09-166691, filed on Jun. 10, 1997, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming method, comprising:

forming an image on a transfer layer of an image transfer material;

transferring the image onto an image receiving material together with at least one part of the transfer layer; and then forming a transparent resin layer on at least one part of the image transferred on the image receiving material to prepare an image supporting material wherein a difference between a maximum thickness and a minimum thickness of the transparent resin layer is greater than about 3 $\mu$m.

2. The image forming method of claim 1, wherein the image receiving material comprises a substrate and wherein the substrate comprises a canvas.

3. An image forming method, comprising:

providing an image transfer material, which comprises a transfer layer and an image formed on the transfer layer;

transferring the image onto an image receiving material together with at least one part of the transfer layer; and then forming a transparent resin layer on at least one part of the image transferred on the image receiving material to prepare an image supporting material, wherein a difference between a maximum thickness and a minimum thickness of the transparent resin layer is greater than about 3 $\mu$m.

4. The image forming method of claim 3, wherein the image receiving material comprises a substrate and wherein the substrate comprises a canvas.

5. The image forming method of claim 1, wherein the transparent resin layer is formed by brush coating.

6. The image forming method of claim 3, wherein the transparent resin layer is formed by brush coating.

7. An image forming method, consisting essentially of:

forming an image on a transfer layer of an image transfer material;

transferring the image onto an image receiving material together with at least one part of the transfer layer; and then forming a transparent resin layer on at least one part of the image transferred on the image receiving material to prepare an image supporting material.

8. An image forming method, consisting essentially of:

providing an image transfer material, which comprises a transfer layer and an image formed on the transfer layer;

transferring the image onto an image receiving material together with at least one part of the transfer layer; and then forming a transparent resin layer on at least one part of the image transferred on the image receiving material to prepare an image supporting material.

* * * * *